United States Patent [19]

Adcock

[11] Patent Number: 4,499,957

[45] Date of Patent: Feb. 19, 1985

[54] METHOD FOR REMOVING EARTH CUTTINGS FROM HOLES BEING FORMED BY A PNEUMATICALLY EXHAUSTED DRILL TOOL

[76] Inventor: Gerald Adcock, 2033 - 3rd Ave. North, Lewiston, Id. 83501

[21] Appl. No.: 443,231

[22] Filed: Nov. 22, 1982

[51] Int. Cl.[3] ..... E21B 7/18

[52] U.S. Cl. ..... 175/71; 175/320

[58] Field of Search ..... 175/61, 69, 71, 212, 175/320, 325

[56] References Cited

U.S. PATENT DOCUMENTS

| | | | |
|---|---|---|---|
| 1,801,788 | 4/1931 | Zublin | 175/212 |
| 2,595,715 | 5/1952 | Sloan | 175/212 |
| 3,172,487 | 3/1965 | Klotz | 175/71 |
| 4,076,083 | 2/1978 | Sizer | 175/65 |

FOREIGN PATENT DOCUMENTS

| | | | |
|---|---|---|---|
| 126827 | of 1959 | U.S.S.R. | 175/71 |

*Primary Examiner*—George A. Suchfield
*Assistant Examiner*—William P. Neuder
*Attorney, Agent, or Firm*—Wells, St. John & Roberts

[57] ABSTRACT

Disclosed is an apparatus and method for reducing the quantity of air or other gas needed to remove earth cuttings from a hole being drilled in the earth. The apparatus includes an accelerator core having connectors at each end for installing the accelerator in a string of drilling pipe. The accelerator core is hollow so that compressed air can be conveyed through to the drill tool assembly. Attached to the accelerator core is a pair of flanges which support a sleeve. The apparatus restricts the available flow area thereby accelerating the flow of air exhausting from the drill hole, to remove the drill cuttings using a minimum of pneumatic gas. The accelerators are spaced appropriately throughout the drilling string.

1 Claim, 3 Drawing Figures

FIG 1
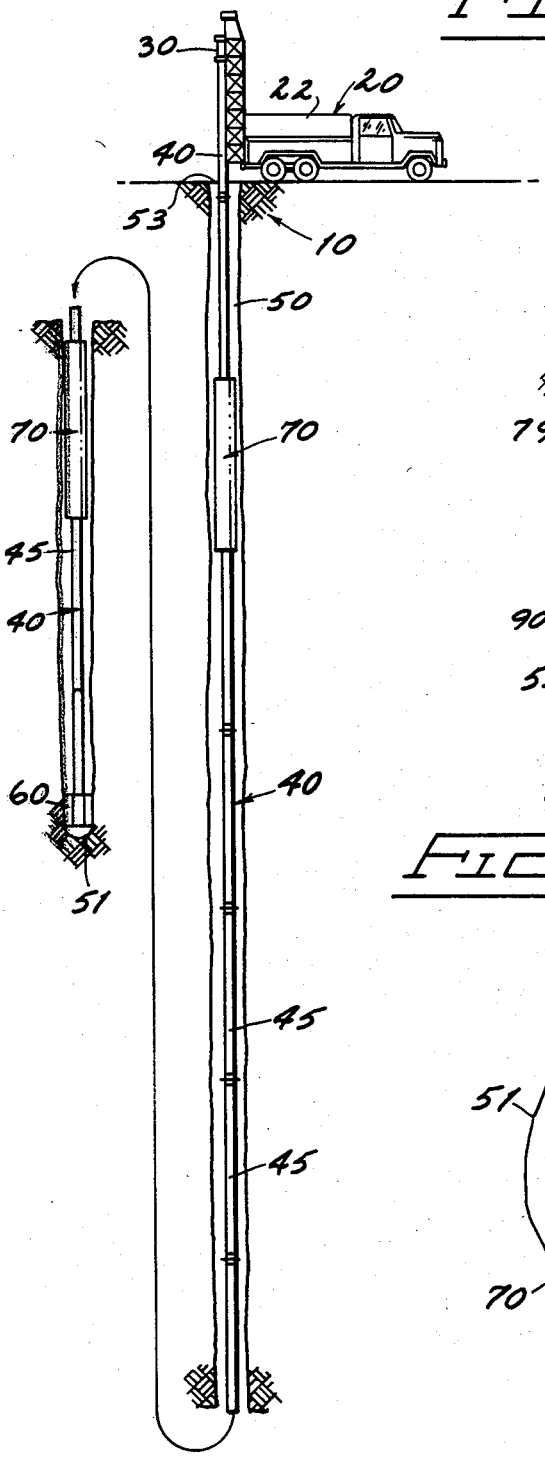
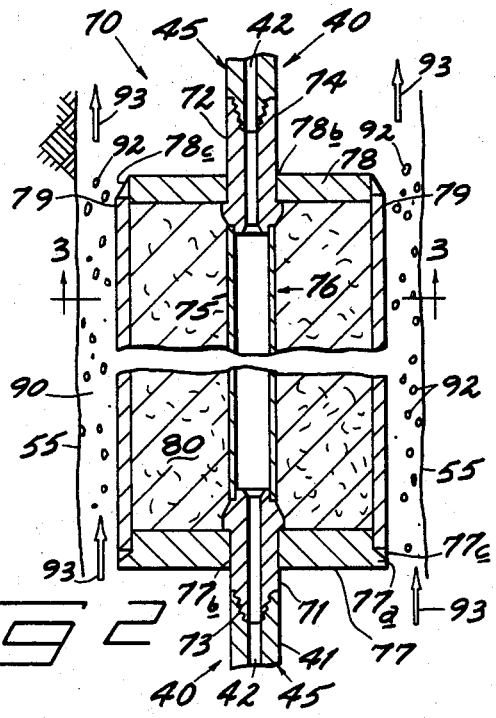
FIG 2
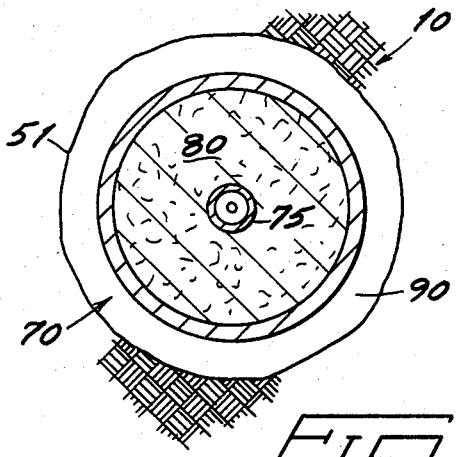
FIG 3

METHOD FOR REMOVING EARTH CUTTINGS FROM HOLES BEING FORMED BY A PNEUMATICALLY EXHAUSTED DRILL TOOL

TECHNICAL FIELD OF THE INVENTION

The technical field of this invention includes methods and equipment for drilling large diameter earth holes using pneumatically exhausted rock drilling equipment.

BACKGROUND OF THE INVENTION

It is often necessary in mining, oil production, engineering and construction to produce holes in rock and other earth formations. Many types of rock drilling equipment use air or some other pneumatic gas which exhausts at the drill bit to bring the earth cuttings to the surface. Rotary conical roller rock bits, blade bits and downhole drilling equipment are examples of drilling equipment types which use exhausting pneumatic gas to remove earth cuttings.

Downhole equipment uses a drill and power unit therefor which progresses into the hole as the rock is removed. Most downhole rock drilling equipment is pneumatically powered using air as the pneumatic gas. Downhole drilling equipment has previously been developed for drilling relatively large diameter holes using drilling pipe having a diameter substantially smaller than the hole. The term large diameter holes is intended to mean holes with diameters of approximately 17 to 36 inches or larger. The small diameter drilling pipe used to drill large holes is commonly about 5½ inches in diameter although other diameters are used and are considered small if the ratio between the hole diameter and pipe diameter is greater than 2 to 1.

Drilling of these large diameter holes requires large amounts of compressed gas to remove the drill or earth cuttings from the base of the hole. The large amount of gas flow is needed because of the large annular cross-sectional area between the small diameter drilling pipe and the large diameter hole wall. The compressed gas must flow through this large area at a high velocity to entrain and remove the cuttings. A high velocity flow over such a large area requires large amounts of compressed air or other gas.

One prior art approach to reduce the required amount of compressed air involves using a double-walled drilling pipe along the entire drilling string. Such continuous double-walled drilling pipe has a relatively large outside diameter so that the annular cross-sectional flow area is reduced. Since the flow area is reduced, the amount of compressed gas needed to remove the earth cuttings is also reduced.

Large diameter double-walled drilling pipe has been found satisfactory for drilling relatively shallow holes but is unsatisfactory for drilling deep holes. The term deep holes refers to holes in the range of 200 to 1,000 feet or greater. A deep hole drill string made of double-walled pipe requires very large and costly equipment to lift and handle the drill string if it is possible to do so at all. The heavy weight of the drill string also makes it very difficult to accurately control the load placed upon the drilling tool. Excessive loading of the drilling tool causes damage to the tool and premature failure.

Because of these problems it has been difficult and often impossible to drill deep large diameter holes with prior art equipment and drilling methods. When double-walled pipe could not be used because of its weight, it was sometimes possible to use small drilling pipe with large amounts of compressed air to expel the cuttings from the hole. Using such large amounts of compressed air is costly because of the large capital investment in compressor equipment. Capital costs alone are currently about $77 per cubic foot of compressed air capacity. If 5½ inch drilling pipe is used in a 36 inch hole, the required airflow necessary to produce sufficient velocity is about 13,900 cubic feet per minute. Just the capital investment for providing such large amounts of compressed air is very substantial and is a determinative factor in preventing many small independent drillers from entering the market for drilling large diameter deep holes. A reduction in the required compressed air capacity also reduces the fuel and maintenance costs. Thus it can be seen that there is a great need for reducing the amount of compressed air necessary to drill earth holes, particularly deep, large diameter holes. It can also be understood that greatly reducing the capital equipment cost associated with drilling earth holes will enable a large number of smaller drilling companies to vigorously compete in the market, thereby further reducing drilling costs.

BRIEF DESCRIPTION OF THE DRAWINGS

A preferred embodiment of the invention is illustrated in the accompanying drawings in which:

FIG. 1 is a diagrammatic representation of a drilling system employing the entrained flow accelerator of this invention.

FIG. 2 is a cross-sectional side view of one entrained flow accelerator positioned in the hole as shown in FIG. 1; and FIG. 3 is a cross-sectional view of the entrained flow accelerator of FIG. 2 taken along line 3—3.

DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

FIG. 1 shows a drilling system used in drilling a hole in rock formations 10. The drilling rig 20 has a drill string feed and support mechanism 30 mounted for supporting and progressively feeding drill pipe to a drill string 40 as drilling progresses. The drill string 40 extends into hole 50 through a hole opening 53. A drill tool assembly 60 is located at the distal or downhole end of the drill string near the base or closed end 51 of hole 50. Positioned along the drill string 40 are a plurality of entrained flow accelerators 70 for facilitating the removal of drill cuttings from the base 51 to the opening 53 of hole 50. A plurality of small diameter drill pipe sections 45 are connected between the accelerators 70.

The entrained flow accelerators 70 are shown in more detail in FIGS. 2 and 3. Each accelerator 70 forms a section of the drill string 40. Drill string 40 is hollow with gallery 42 conveying compressed gas from the drill string feed and support mechanism 30 to the drill tool assembly 60. Compressed pneumatic gas is supplied from a compressor 22 mounted on truck 20.

The accelerators 70 are provided with male connector or tool joint 71 at the male end of the accelerator and female connector or tool joint 72 at the female end of the accelerator. Connectors 71 and 72 must be hollow to form gallery 42 through which the compressed pneumatic gas flows to the drill tool assembly 60. Connectors 71 and 72 can be of various types and should be compatible with the type of connectors generally used in the drill string 40. In the preferred form of the invention male connector 71 is provided with tapered male threads 73 which are received in a female connector 41 which forms a part of an adjacent piece of drilling pipe 45. Similarly, female connector 72 is provided with interior or female threads 74 which are capable of receiving and holding a male connector 42 which forms a part of an adjacent piece of drilling pipe 45. Male and female connectors 71 and 72 are rigidly connected to tube 75 to form the accelerator core 76.

The accelerator core 76 is provided with two flanges 77 and 78 which are rigidly connected thereto. Baffle plate 77 is preferably provided with shoulder 77*a* for providing greater resistance to erosion and to prevent accelerator sleeve 79 from sliding off if weld 77*c* should fail. Baffle plates 77 and 78 support accelerator sleeve 79 in a substantially coaxial relationship with accelerator core 76.

Accelerator sleeve 79 defines the exterior of accelerator 70 and the inside of the annular flow area 90. Annular flow area 90 is the area through which the drill cuttings must pass as they are carried outwardly through hole 50 by large volumes of pneumatic gas released at the drill tool 60. Accelerator sleeve 79 encloses a space 80 which is preferably filled with a filler material to exclude drill cuttings if a leak should develop in sleeve 79 or flanges 77 and 78.

The accelerator works by restricting the available cross-sectional area through which the exhausting pneumatic gas can flow. This restriction in the available flow area causes the exhausting gas 93 to accelerate to a higher velocity. Since the drill or earth cuttings 92 are entrained in the flow of exhausting gas 93, they also accelerate to a higher velocity and are carried upwardly. The accelerators are appropriately spaced along the drilling string 40 so that the drill cuttings 92 are effectively thrown from one accelerator to the next accelerator without requiring the tremendous volumes of gas necessary to entrain and carry them upward in a steady flow through a greater cross sectional flow area. It also appears that a somewhat laminar type flow occurs in the space between the accelerators to help maintain the stream of gas and cuttings along the periphery of hole 50 near hole wall 55.

The diametrical size of the accelerator 70 is an important parameter because it defines the annular flow area 90 through which the exhaust gas 93 must pass. The greater the size of area 90, the lower the velocity of the gas flowing through cross-sectional area 90. If area 90 becomes too small, the pressure drop across each accelerator 70 becomes too large and greater gas pressure is needed. If area 90 is too small it also causes severe erosion of the accelerator sleeve 79 and flanges 77 and 78 because of the turbulent and erosive action of the earth cuttings as they are accelerated to high velocities and impinge upon or are drug along the surfaces of the accelerator. The cuttings may also cause erosion or cavitation of the hole wall 55 if the velocity and turbulence is too great.

In the drilling of large diameter holes between 17 and 36 inches in diameter, it has been found acceptable to have an annular cross-sectional flow area 90 of between 78 and 198 square inches. A range of 125 to 165 square inches has been found optimal in terms of reduced gas usage and minimum wear on accelerator surfaces.

The length of accelerator 70 is also an important parameter because it determines the amount of time during which the high velocity exhaust gas 93 can act on the earth cuttings 92 to accelerate the cuttings to a higher velocity. If the length of the accelerator is not sufficiently long then the cuttings 92 will not receive the optimal amount of acceleration for greatest efficiency. If the accelerator 70 is made too long the cost and weight of the accelerator increases without appreciable improvement in removal of the cuttings 92.

In the drilling of large diameter holes, it has been found appropriate to use accelerators 70 having a length between 5 and 35 feet. A range of between 12 and 18 feet has been found optimal in terms of minimum weight with good acceleration of the cuttings 92.

The spacing of the accelerators 70 is another important parameter to the proper operation of the invention. If the accelerators are spaced too far apart the cuttings are not properly conveyed. If the accelerators are spaced too unnecessarily close together then capital costs increase and the weight of the drill string is unnecessarily heavy. A range of 50 to 200 feet has been found to be operable spacing between adjacent accelerators 70. The optimal spacing is in the range of 100 to 125 feet. The proper spacing of the accelerators is affected by the velocity of the gas flow about the accelerators and the length of the accelerators.

Another parameter important to the proper operation of the invention is the volume of gas flow about the accelerator. An operable range is between 12 and 25 cubic feet per minute for each square inch of cross-sectional flow area 90. The optimal range is between 13 and 14 cubic feet per minute for each square inch of cross-sectional flow area 90. This optimal flow rate corresponds to a velocity of approximately 1872 feet per minute assuming the exhausting gas is at atmospheric pressure. Since the air is slightly compressed, the actual velocity will be less. The volumetric flow rates given herein are in terms of standard cubic feet of gas at standard atmospheric pressure since pressures will vary slightly along the length of the holes. These figures may not be exact for in-place measurements.

The entrained flow accelerators 70 are used by assembling them into the drilling string 40 in a manner similar to the assembly of drilling pipe sections 45 which make up most of the drilling string. The first accelerator 70 is preferably spaced from the drill tool assembly 60 by one section of drill pipe 45. Thereafter, an accelerator 70 is placed approximately every 100 feet as the length of the drilling pipe sections allow. The male and female connectors or tool joints 71 and 72 are connected with the mating tool joints 41 and 42 of drilling pipes 45. The drilling string 40 is constructed in this manner as the drill tool assembly 60 is lowered into the hole to drill deeper into the rock formation.

The accelerator 70 is preferably made in the following manner although numerous other configurations and methods are available for accomplishing the same result. Such various configurations and manners of making the invention are equally within the contemplation of this invention. The male and female connectors 71 and 72 are commonly available drilling pipe connectors. These connectors are welded to the tube 75 to make the accelerator core 76. The flanges 77 and 78 are preferably machined from steel in the desired shape and are provided with openings 77*b* and 78*b* which are smaller than the outside diameters of connectors 71 and 72 to produce an interference fit.

The accelerator is assembled by first heating flange 77 and installing it upon the male end 71 of accelerator core 76. Baffle plate 78 is tack welded to sleeve 79 at weld 78*c*. Baffle plate 78 is then heated and together with sleeve 79 slid onto accelerator core 76 so that flange 78 has an interference fit when mounted on female connector 72. Sleeve 79 is then securely welded to flange 77 at weld 77*c* and to flange 78 at weld 78*c*. The interior volume 80 is airtight to prevent it from filling with drill cuttings 92. Volume 80 can also be filled with a filler material such as closed cell synthetic resin foam to exclude cuttings even if a leak develops in the accelerator.

This invention also includes a method for removing earth cuttings from holes being formed by a pneumatically exhausted drill tool. The method first comprises the step of exhausting pressurized air from the drill tool 60 so that the earth cuttings are flushed from the face of the drill tool. The exhausting air also entrains the cuttings in a gas stream 93 which flows along the outside of the drill string 40.

The next step in the method is to intermittently accelerate the gas stream 93 at spaced locations along the drill string 40. This intermittent acceleration of the gas stream causes the cuttings 92 to be accelerated by the increased aerodynamic drag associated with the higher velocity of gas stream 93. It also appears that a somewhat laminar type flow occurs along the sections of drill pipe 45. This laminar flow helps to keep the gas stream 93 and the entrained cuttings 92 along the hole wall 55. This unexpected effect was discovered by the inventor and is important to the operation of the invention. It would ordinarily be expected by one skilled in the art that great turbulence would cause the cuttings 92 to stray from the gas stream 93 and prevent the cuttings from exiting from hole 50.

The step of intermittently accelerating the gas stream 93 and cuttings 92 is affected by several factors. One such factor is the distance or time over which the accelerated gas stream 93 has to act upon the cuttings 92. The method is operable when gas stream 93 is passed through annular passageways 90 (FIG. 3) having lengths of between 5 and 35 feet. A range of between 12 and 18 feet is considered optimal when weight, cost, and performance are considered.

Another factor significant to the method of this invention is the volume flow rate through the reduced cross-sectional flow areas 90. The flow rate and size of cross-sectional area 90 is determinative of the velocity of the gas stream 92 passing therethrough. Flow rates of between 12 and 25 standard cubic feet per minute for each square inch of cross-sectional flow area 90 have been found operable. The optimum range is between 13 and 14 standard cubic feet per minute for each square inch.

The amount of available flow area 90 is also significant to the successful operation of this method. A range of between 78 and 198 square inches has been found operable. An optimum range is between 125 and 165 square inches. The appropriate amount of area 90 depends upon the size of hole 50 being drilled.

Another factor significant to this method is the spacing distance between the intermittent accelerations of gas stream 93. When operating conditions fall within the ranges set forth above, the intermittent accelerations can be placed between 50 and 200 feet apart. An optimal range has been found to be between 100 and 125 feet.

EXAMPLE

The method and apparatus of this invention was used to drill two 24 inch diameter holes at a mine site in the State of Utah. The holes were drilled to depths of 850 and 1010 feet. Drilling pipe sections having a nominal 4.5 inch diameter were used for most of the drill string. Accelerators having an 18 inch diameter and 15 foot length were installed in the drill string at intervals of 100 feet or at the drilling pipe joint nearest this spacing. The first accelerator was installed with one section of drill pipe between it and the drill tool assembly. Optimal airflow requirements ranged between 2600 and 2700 cubic feet per minute at a supply pressure of 250 pounds per square inch. This roughly corresponds to a flow rate of 13 to 14 cubic feet per minute for each square inch of cross-sectional flow area. The earth cuttings were successfully removed during the drilling of both holes.

The above example can be used to give an indication of the savings associated with this invention. With the air flow requirement of 2700 cubic feet per minute at an estimated capital investment cost of $77 for each cubic foot per minute capacity, the resulting capital investment cost is $207,900. If the same hole had been drilled without using accelerators 70 then an airflow of 6104 cubic feet per minute would be needed to remove the cuttings 92 with a 14 cubic feet per minute per square inch flow rate. The estimated capital investment cost for 6104 cubic feet per minute capacity is $470,008. This corresponds to a savings of $262,108 in capital investment costs. There would also be significant cost savings for reduced fuel consumption and reduced maintenance costs. These very significant costs savings can be accomplished by using the invention with equipment capable of handling small diameter drilling pipe. The large and costly equipment previously needed to handle strings of continuous double-wall drilling pipe is no longer needed to reduce the air flow requirements for drilling large diameter deep holes.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. In a method for drilling holes in the earth using a pneumatically exhausted drill tool mounted at the distal end of an elongated drill string composed of a plurality of drill pipe sections wherein the improvement is a method for removing earth cuttings from the hole with a minimum amount of exhausting pneumatic gas or air without significantly increasing the weight or diameter of the drill string, comprising:

exhausting sufficient pressurized gas from the drill tool to initially flush the earth cuttings from the base of the hole as the cuttings are being formed and to entrain the cuttings in a gas stream along the outside of the drill string; and intermittently accelerating the gas stream at spaced locations along the drill string by passing the exhausting gas through elongated approximately annularly shaped passageways of reduced cross-sectional flow area formed by entrained flow accelerators placed intermittently in the drill string; the intermittent entrained flow accelerators being spaced apart approximately 50 to 200 feet and having lengths of between 5 and 35 feet; the entrained flow accelerators being sized to define annular cross-sectional flow areas which are between approximately 20 and 60 percent of the cross-sectional area of the hole; pressurized gas from the drill tool being exhausted at flow rates in the range between approximately 12 and 25 standard cubic feet per minute for each square inch of said annular cross-sectional flow area of said passageways to maintain the gas stream at a sufficient velocity to carry the suspended earth cuttings along the outside of the drill string to remove the cuttings from the hole.

* * * * *